US005645516A

United States Patent [19]

Foster

[11] Patent Number: 5,645,516

[45] Date of Patent: Jul. 8, 1997

[54] THERAPEUTIC LOWER EXTREMITY EXERCISER AND FOOT REST

[76] Inventor: Betty J. Foster, 5820 W. Broadway, Crystal, Minn. 55428

[21] Appl. No.: 259,866

[22] Filed: Jun. 15, 1994

[51] Int. Cl.[6] ..... A63B 23/08

[52] U.S. Cl. ..... 482/79; 482/121; 482/122; 482/129

[58] Field of Search ..... 482/79, 80, 121, 482/122, 123, 125, 129, 130; 601/33, 34, 35

[56] References Cited

U.S. PATENT DOCUMENTS

| | | | |
|---|---|---|---|
| 3,295,847 | 1/1967 | Mah, Sr. | 482/80 |
| 3,421,760 | 1/1969 | Freeman, Jr. | 482/80 |
| 3,430,956 | 3/1969 | Borgeas . | |
| 3,792,860 | 2/1974 | Selnes | 482/95 |
| 4,306,714 | 12/1981 | Loomis et al. | 482/79 |
| 4,452,447 | 6/1984 | Lepley et al. | 482/79 |
| 4,605,220 | 8/1986 | Troxel . | |
| 4,930,767 | 6/1990 | Hamm | 482/80 |
| 5,035,421 | 7/1991 | Scheller . | |
| 5,186,698 | 2/1993 | Mason et al. . | |
| 5,221,242 | 6/1993 | Weber et al. . | |
| 5,279,530 | 1/1994 | Hess . | |

FOREIGN PATENT DOCUMENTS

| | | | |
|---|---|---|---|
| 2688141 | 9/1993 | France | 482/122 |
| WO93/04655 | 3/1993 | WIPO . | |

*Primary Examiner*—Jeanne M. Clark
*Attorney, Agent, or Firm*—Janet Peyton Schafer

[57] ABSTRACT

A therapeutic multi-component exercise kit for rehabilitative or maintenance purposes. The components can be combined in several different ways to provide exercise for specific muscles. One such combination includes a base and pedal arrangement, whereby resistance is provided by at least one elastomeric band, for dorsiflexion strengthening exercise. Another combination includes a belt having elastomeric loops for plantar flexion strengthening exercise. Inversion and eversion exercise is provided, as is external and internal rotation of the patient's foot, again using elastomeric bands to provide resistance.

14 Claims, 9 Drawing Sheets

THERAPEUTIC LOWER EXTREMITY EXERCISER AND FOOT REST

BACKGROUND

This invention relates generally to an exercise system for exercising the lower extremities of the human body. More particularly, the present invention relates to a multi-component kit for therapeutically exercising the lower leg wherein the components of the kit are interchangeable to provide several different lower leg exercises.

Victims of athletic and accident injury, stroke, and certain degenerative disease processes, such as multiple sclerosis, myasthenia gravis and arthritis, benefit from therapeutic exercise of the lower limbs. Patients receive more beneficial results if they can do their therapeutic exercise on a regular basis, even several times a day. Patient participation in the therapeutic exercises is usually increased if the patient can perform the exercises at home or at work without the necessity of traveling to the hospital or clinic for therapy sessions.

Exercise devices available for lower leg exercising are generally limited in their purpose in that they exercise a limited number of muscles. Also, many of the available exercise devices are heavy and difficult to transport which limits the ability of the patient to include therapeutic exercise in their daily life. Many of the exercise devices available are expensive and also complex in their structure requiring added expense in maintenance and repair.

Some available exercise devices make use of elastomeric rubber tubing as resistance to move against. Experience has shown that this tubing easily rolls off the foot, interrupting the exercise routine.

Many available exercise devices have buckles and other types of fasteners that are difficult for patients with limited strength and dexterity to use.

Most available exercise devices do not have devices for measuring amount of movement allowing the patient to measure progress or maintenance of range of motion.

Definitions

Dorsiflexion of the foot is the bending of the foot backwards elevating the toes above the heel. This stretches the back of the lower leg, specifically, stretching the Achilles tendon and occurs when flexing the muscles on top of the foot and in front of the lower leg. The Achilles tendon can also be stretched passively as a result of pulling the toe towards the knee.

Plantar flexion of the foot is bending of the foot downwards, pointing the toes below the heel. This stretches the front of the lower leg and occurs when flexing the back lower leg muscles.

Internal rotation of the foot, rotating the foot about an axis extending through the ankle joint and heel, brings the foot nearer the opposing foot, stretching the muscles attached to the outside of the foot and lower leg and occurs when muscles attached to the inner surface of the foot and lower leg contract. External rotation of the foot, about the same axis, pulls the foot away from the opposing foot, stretching the inside muscles of the foot and lower leg when muscles attached to the outside of the leg and foot contract.

Inversion and eversion are the rotating of the foot about an axis extending from heel to toe, inversion being rotation inward towards the opposing foot, and eversion being rotation outwardly away from the opposing foot. Both exercises promote flexibility of the ankle joint.

For the foregoing reasons, there is a need for an easy-to-use, portable, cost-effective exercise kit that provides and measures a broad range of therapeutic exercises to the lower leg for use in a variety of situations, including rehabilitation departments, in the home and in the work-place, and with a variety of patients, even those with limited motor ability and strength such as those suffering degenerative disease or who are bedridden.

SUMMARY

The present invention is directed to apparatus that satisfies this need for a cost-effective therapeutic exercise kit for exercising the lower leg. The kit contains a number of components which may be combined in a variety of combinations to provide the patient with a device to exercise different specific sets of muscles.

A lower extremity exercise kit having features of the present invention comprises a base plate, a pedal hinged to the base plate and having a heel strap mounted at the heel end of the pedal, a pair of toe straps, having hook and loop fasteners, for positioning the patient's foot on the pedal, and an elastomeric band, mounted on the base plate and received by a slot at the toe end of the pedal, for providing resistance against dorsiflexion movement of the patient's foot when the patient's foot is strapped into position.

A measurement guide is provided to measure the range of dorsiflexion motion of the patient, by the patient, or by a therapist attending the patient. The measurement guide has both a measure table, in inches or centimeters, and a color coded guide on both its sides for easy observation.

More than one elastomeric band can be removably attached to the pedal, providing increased resistance against dorsiflexion movement by the patient.

An adjustable heel strap, having a bolt and nut arrangement received by a slot in the base, accommodates a variety of foot sizes.

A wedge is provided to position the pedal, for passively stretching the patient's Achilles tendon, when the patient's foot is in a resting position. The wedge may be positioned by manually raising the pedal or by dorflexing the patient's foot raising the attached pedal and placing the wedge under the pedal.

A cord is provided, having a handle at one end and a series of loops formed along the cord. The loops provide adjustability to the cord by allowing the patient to select the most comfortably positioned loop. Use of the cord, when attached to the patient's foot, actively stretches the Achilles tendon. The cord can be used for the same purpose independent of the base and pedal unit. Additionally, use of the cord in this manner can provide passive movement of a paralyzed leg.

A belt, having an elastomeric loop attached, is provided for providing plantar flexion movement exercise. The elastomeric loop is positioned in the toe slot of the pedal, providing plantar flexion resistance when the patient pushes the pedal down, exercising the front leg muscles. The measurement guide can be used to measure the progress or maintenance in this exercise the patient has made. The belt, with associated elastomeric loop, can be used without the base and pedal unit. Resistance to plantar flexion movement can thus be provided, even while the patient is in a supine position. Additional elastomeric loops can be added to increase resistance.

Ankle straps are provided, for attaching around the patient's ankle by means of hook and loop attachments positioned on ends of the straps, for maintaining the position of the patient's heel adjacent the pedal during use for internal and external rotation of the foot.

Resistance to internal and external rotation of the foot, for providing therapeutic exercise, can be accomplished by using the base plate, pedal, heel strap, pair of ankle straps, and at least one elastomeric band received by slots in the pedal. Loosening the ankle strap permits the patient to exercise against resistance to inversion or eversion motion in the foot.

The base plate provided is sized to be larger than the pedal to provide a sturdy base for use, even when the patient is in a supine position.

Advantages

An important advantage of the present invention is that it enables a patient to perform a broad range of lower leg exercises, including dorsiflexion and plantar flexion of the foot, internal and external rotation of the foot, and inversion and eversion for rehabilitation of the lower leg in the case of injury or stroke, or maintenance of lower leg range of motion in the case of degenerative disease. Additionally, the exercise kit can provide an aid to movement of paralysed lower limbs, and even a wedge to elevate the foot of a patient susceptible to "foot drop".

Another advantage of the present invention is that at least one measure guide is provided to measure range of motion enabling the patient to gauge progress or maintenance of range of motion.

An additional advantage of the present invention is that some of the components can be used alone, ex. the belt with elastomeric loops and the cord with handle, to provide dorsiflexion and plantar flexion exercise. Additionally, the cord can be used to provide passive movement to a paralyzed leg.

Another advantage of the present invention is that because of it's small size and light weight, it can be transported easily. The hook and loop fasteners on the straps enable even those with severe arthritis to fasten the straps around their own feet for independent utilization of this exercise device.

An additional advantage is the adjustability of the exercise device, by means of the toe and ankle straps, and heel adjustment means to accommodate a variety of foot sizes.

Another advantage of the present invention is the easy adjustment of resistance against movement that forms the basis for the exercises performed with this invention. The amount of resistance within an exercise can be easily increased by the addition of elastomeric bands, or bands of greater resistance, for dorsiflexion, rotation, and inversion/eversion exercises, and addition of elastomeric loops for plantar flexion exercise.

A further advantage of the present invention include its simplicity of construction lowering the cost of the apparatus, and, because there are few elements that can break down, simplifying repair and maintenance.

An additional advantage is that all of the materials used can be disinfected, which is particularly important in a clinical setting.

BRIEF DESCRIPTION OF THE DRAWINGS

Understanding of the invention will be enhanced by referring to the accompanying drawings, in which like numbers refer to like parts in the several views and in which.

DETAILED DESCRIPTION OF THE PREFERRED EMBODIMENTS

Figure 1:
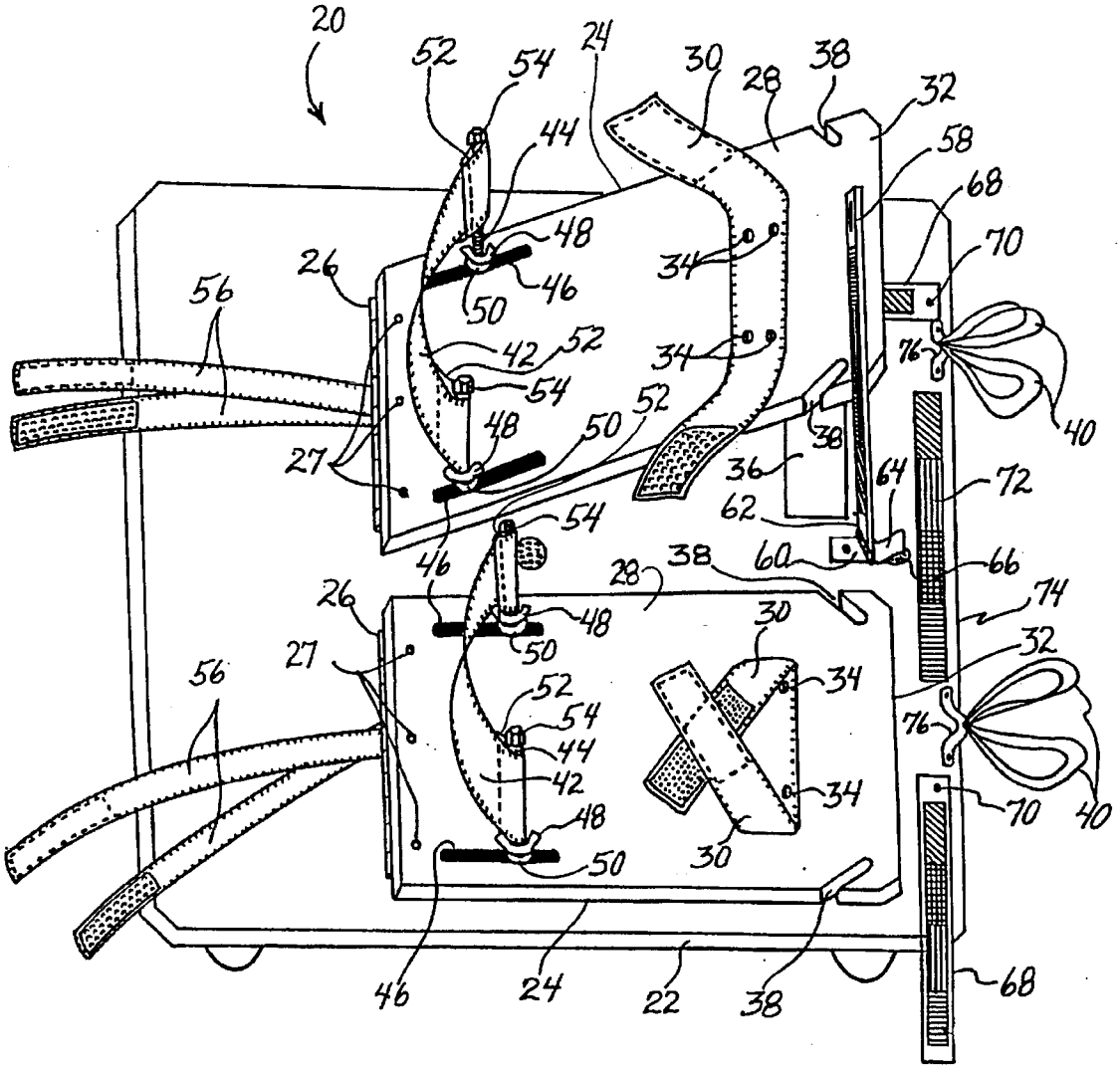
FIG. 1 is a perspective view of the exercise device component of the invention.

Understanding of the invention will be further enhanced by referring to the following illustrative but nonlimiting example.

Overview of Main Elements

Therapeutic lower extremity exerciser 20 and foot rest is an exercise kit consisting of two foot pedals 24 attached to a base plate 22, a handle 92 and cord component 90 (for passive movement), a plantar flexion belt component 110 with elastomeric loops 112 for plantar flexion movement, and a pair of foot wedges 130 as a foot rest, providing passive stretching of the Achilles tendon.

Detailed Description

Figure 10:
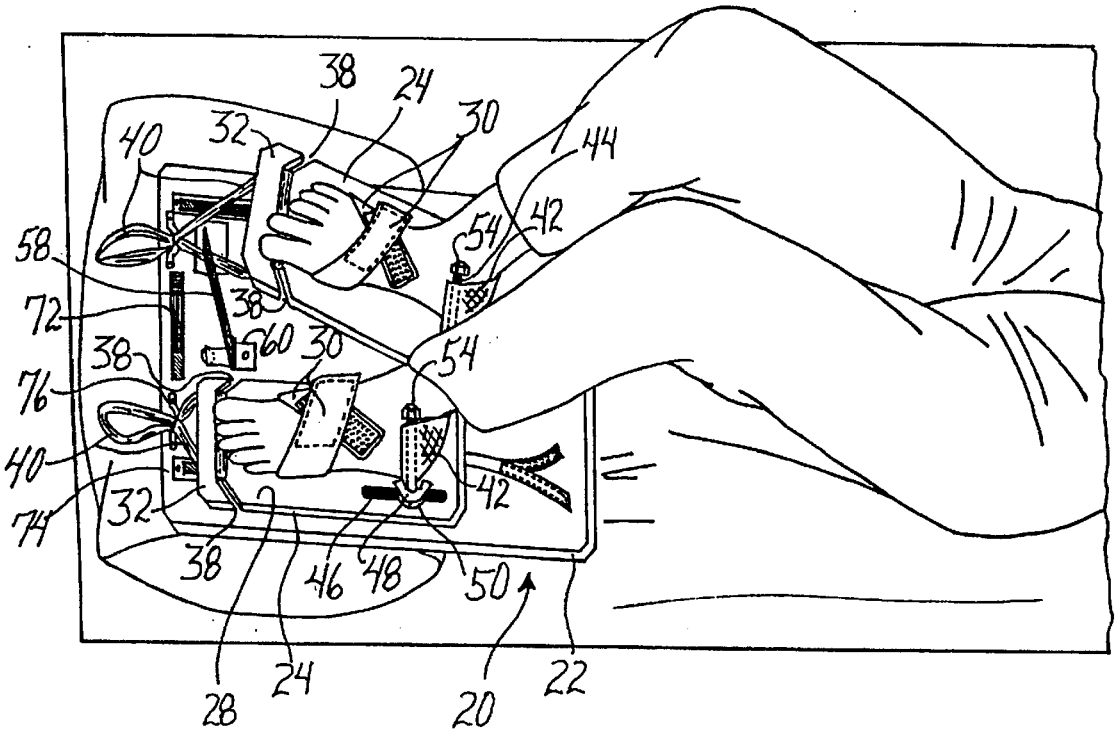
FIG. 10 is a perspective view of the assembly of kit components as used by a patient while reclining.
Figure 11A:
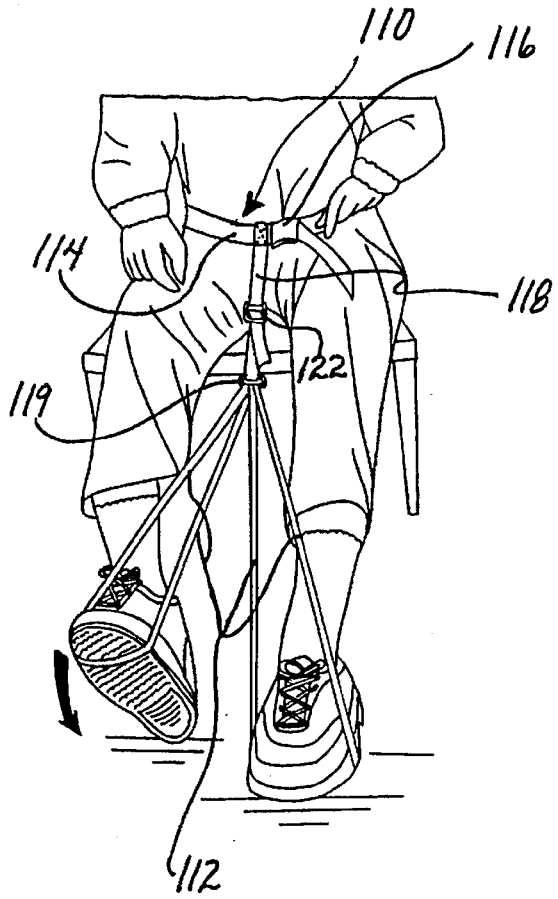
FIG. 11*a* is a perspective view of the belt and elastomeric loop kit as used for plantar flexion movement of the right foot.
Figure 11B:
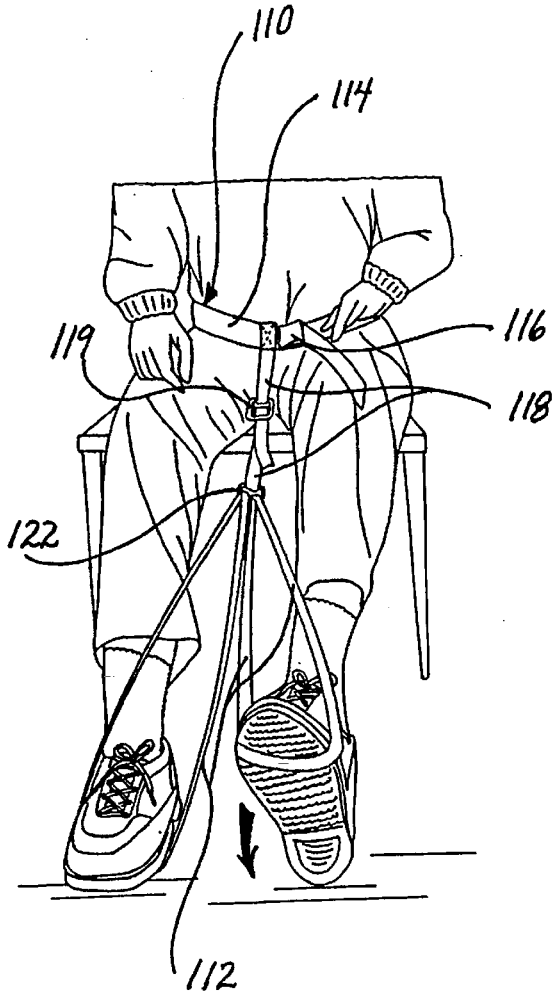
FIG. 11*b* is a perspective view of the belt and elastomeric loop assembly, as shown in FIG. 11*a*, for plantar flexion movement with the left foot.

Base plate 22, of a generally square shape, is preferably formed of linear high density polyethylene, or polypropylene, although other plastics or materials such as wood or ceramic or metal could be used, is provided, as illustrated at FIG. 1. Base plate 22 is sized to be larger than pedal 24 to provide a stationary base on which therapeutic exercises may be performed. Size of base plate 22 is especially important to prevent rocking motion of the exercise device if used by a bedridden patient in a supine position, as shown in FIG. 10. Base plate 22 is not so large as to become cumbersome or heavy. Portability of therapeutic lower extremity exerciser 20 is an important feature.

Two foot pedals 24, preferably formed of the same materials as base plate 22 and shown in detail at FIG. 1, are attached by hinge 26 separately to base plate 22 to allow for individual movement of the patient's feet against force for dorsiflexion therapeutic exercise. On upper surface 28 of each foot pedal 24 is mounted toe strap 30, attached to toe end 32 of foot pedal 24 with bolts or screws 34. Toe straps 30 preferably secure around the toes of patient's foot with hook and loop fasteners, although other means of fastening may be used. A pair of silencer pads 36, is provided, a first pad mounted on the underside of foot pedal 24 and a second pad positioned on upper surface 28 of base plate 22 so as to receive the first silencer pad preventing "clapping" when pedal 24 is pivoted about hinge 26 into position atop base plate 22.

Located on either side of foot pedals 24 near toe end 32 of foot pedal 24 are angled toe slots 38, each extending forward and inwardly into foot pedal 24. Elastomeric bands 40, rubber tubing, cords or straps are received by the toe slot 38 and looped around toe ends 32 of each foot pedal 24 when the patient exercises by plantar flexion, dorsiflexion and/or rotation of each foot. Flat elastomeric bands are preferred because experience has shown that round tubing tends to slip out of the toe slots 38 and interrupt the exercising.

Heel strap 42, in the preferred embodiment of nylon but any material able to be disinfected with suitable characteristics could be used, is affixed near hinge 26 and is perpendicular to upper surface 28 of foot pedal 24. Heel strap 42 is held in position by two bolts 44 that are perpendicular to and extend above the surface of foot pedals 24. Heel slot 46 is provided to received bolt 44. The head of each bolt, not shown, is located on the under surface of heel slot 46 and the threaded portion of bolt 44 extends through heel slot 46 to a position several inches above the upper surface 28 of the foot pedal 24. Each bolt 44 is held in position by means of wing or knurled nut 48 and washer 50, shown at FIG. 1, which is screwed onto each bolt 44 and tightened against upper surface 28 of pedal at heel slot 46. Loops 52 sewn into each end of heel strap 42 are slipped over the threaded portion of bolts 44 and down to the wing or knurled nuts 48. Cap nut 54 is placed on the top of each bolt 44 to keep heel strap 42 in position. By loosening nuts 48 located on top of heel slots 46, the patient can move heel straps 42 forward or rearward to select the proper position of heel strap 42 relative to the patient's foot size.

Fabric ankle strap 56, in the preferred embodiment of nylon, although any suitable strong, washable fabric could be used, is attached to the center of hinge 26 of each foot pedal 24 and held in position by screw or bolt 27. Ankle straps 56 hold the patient's heel down onto pedal 24 when the patient performs various exercises, especially rotation of the foot against resistance, inward/outward rotation and eversion and inversion. Ankle strap 56 can be used to position patient's foot for any activity where the patient cannot control their heel or where the heel rises inadvertently, thereby reducing the efficacy of the exercise. Ankle straps 56 preferably secure around patient's ankle with hook and loop fasteners, although other means of fastening may be used.

Elongated guide strip 58, in actual use conditions a strip approximately ⅛ inch in thickness is used although any size strip that fits onto exercise apparatus is envisioned, is centered between toe ends 32 of foot pedals 24 and is attached to base plate 22 by means of hinge 60 located at an end 62 of guide strip 58. Guide strip 58, is raised to an upright position, generally perpendicular relative to base plate 22, illustrated at FIG. 1, and held in position by hook tab 64 and loop dot 66. Dorsiflexion and plantar flexion movements are measured using guide strip 58. Guide strip 58 is divided into colored segments,on both surfaces thereof, so that the patient and any attendant can read the guide strip 58. Guide strip 58 can also be marked off using inch and centimeter markings.

Two side guides 68, are provided each with a colored and numbered scale, are pivotably attached to the upper surface of base plate 22 by means of a bolt or screw 70, located at an end of strip 68. When not is use, side guide 68 lies in an out-of-the-way position under foot pedal 24. During external rotation of the foot, these side guides 68 can be pivoted to a position that is generally perpendicular to base plate 22. The patient may use these side guides 68 to determine or measure the extent of external rotation for each foot.

Medial scale 72, consisting of a rectangular strip containing a colored and numbered scale, is affixed on base plate 22 near the center and parallel to front edge 74 of base plate 22. Medial scale 72 is used to measure the extent of internal rotation for each foot.

Two eye strap loops 76, of metal or plastic, are attached near front edge 74 of base plate 22 and centered in front of each foot pedal 24. Elastomeric bands 40 are attached to each eye strap loop 76. In use, elastomeric bands 40 are fastened around toe end 32 of each foot pedal 24 and into angled toe slots 38 located on the sides of foot pedals 24. As the patient attempts to dorsiflex the foot, elastomeric band 40 provides resistance to the movement. More than one elastomeric band 40 can be utilized to increase resistance.

Figure 9A:
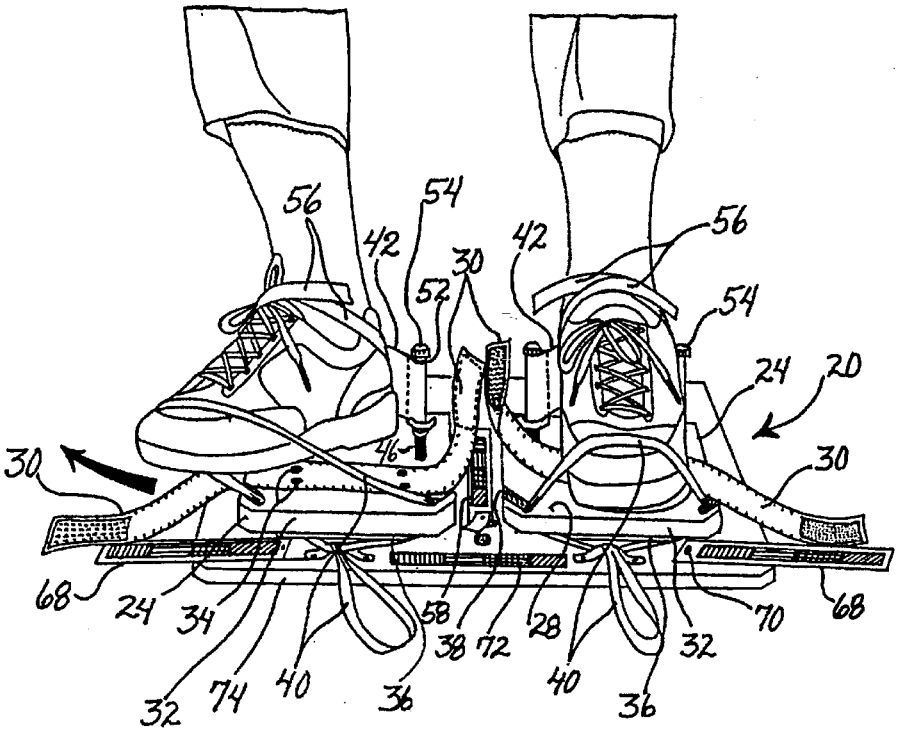
FIG. 9*a* is a perspective view of the assembly of kit components with elastomeric bands in place for external rotation movement strengthening exercise as used by a patient.
Figure 9B:
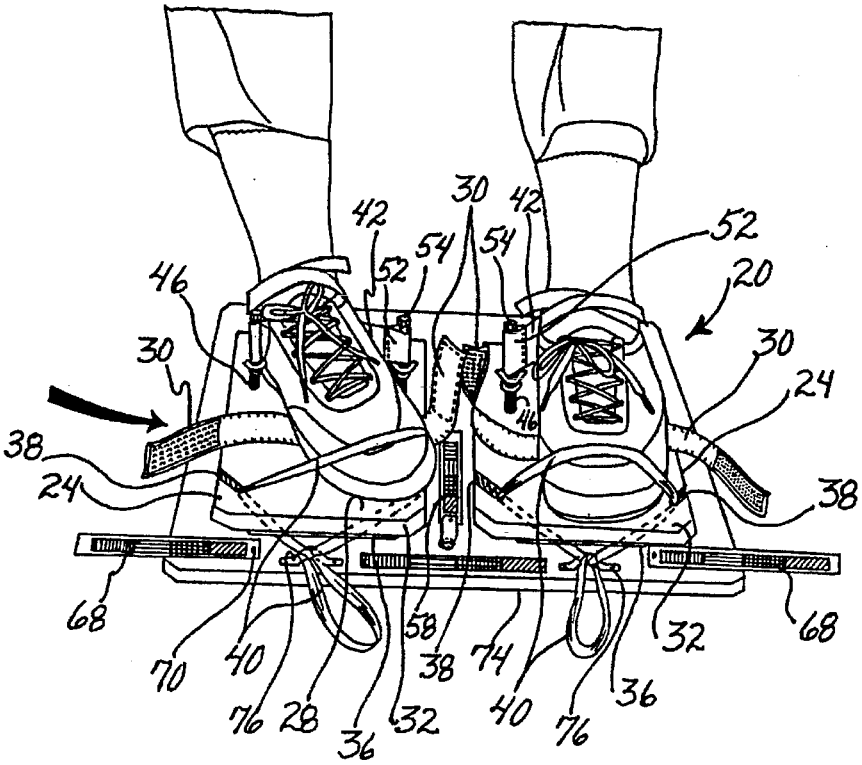
FIG. 9*b* is a perspective view of the assembly of kit components as shown in FIG. 9*a*, for internal rotational movement as used by a patient.

Toe strap 30 can be detached and the patient's foot placed under elastomeric band 40 associated with toe end 32 of foot pedal 24, illustrated at FIGS. 9*a* and 9*b*. As the patient attempts to move each toe from side to side (rotates the foot), elastomeric band 40 provides resistance. The patient can perform this exercise while in a number of positions including reading, watching TV, lying in bed or working at a desk.

Figure 2:
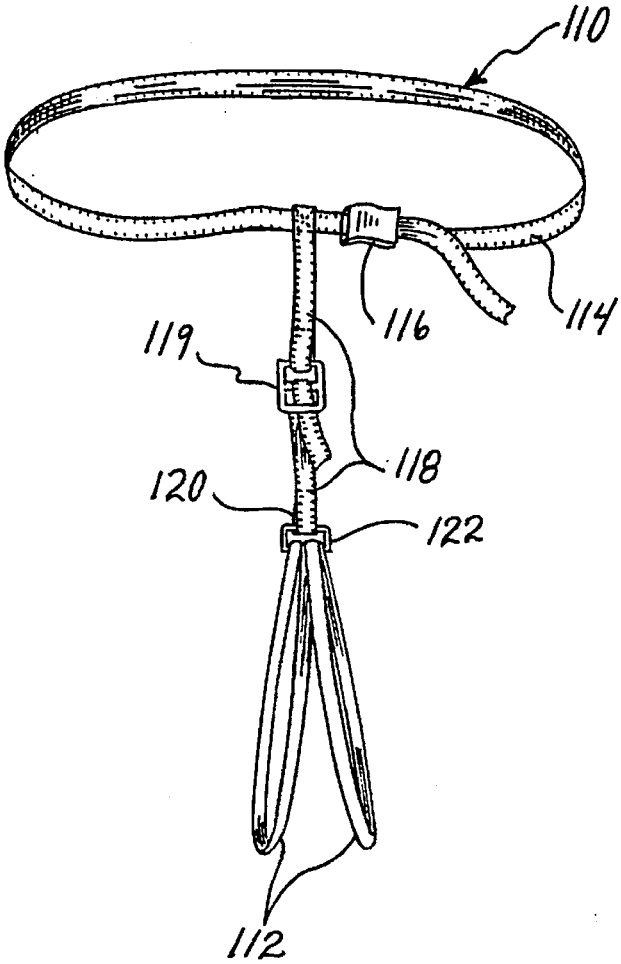
FIG. 2 is a perspective view of the belt with elastomeric loops component of the invention.

Plantar flexion belt 110, shown in detail at FIG. 2, is fastened around the waist of the patient, illustrated in use at FIGS. 6, 8*a*, 8*b*, and 11. Belt 110 consists of fabric strap 114, in the preferred embodiment, of nylon webbing but any suitable material able to be disinfected could be used, with some type of quick release buckle 116 attached to one end of strap 114. Another strap 118 is attached (sewn) to main belt 110 near buckle 116 so that it hangs vertically down from the center of belt 110 and, with bar slide 119 forms an adjustable loop 120. At the end of loop 120 is quick link 122, of rectangular shape and of metal or plastic, that can be opened or closed to allow the attachment of several elastomeric loops 112 or bands. Elastomeric loops 112 can be attached into toe slots 38 around toe end 32 of each foot pedal 24. When the patient presses downward on foot pedal 24, elastomeric loop 112 provides resistance to plantar flexion of the foot. Increased resistance is obtained by attaching more than one elastomeric loop 112 to foot pedal 24. The patient can use belt 110 independently of base plate 22 and pedals 24 by attaching elastomeric loops 112 directly around the toe end of the foot to provide resistance for plantar flexion and passively provide dorsiflexion of the foot of the patient. Since this type of activity does not require the use of the patient's hand, the patient can perform a variety of activities such as work at a desk, watch TV, read, etc.) simultaneously during the exercise period. Belt elastomeric loops 112, used independently of belt 110, can also be stretched in a variety of ways to exercise the arms, chest and back muscles.

Figure 3:
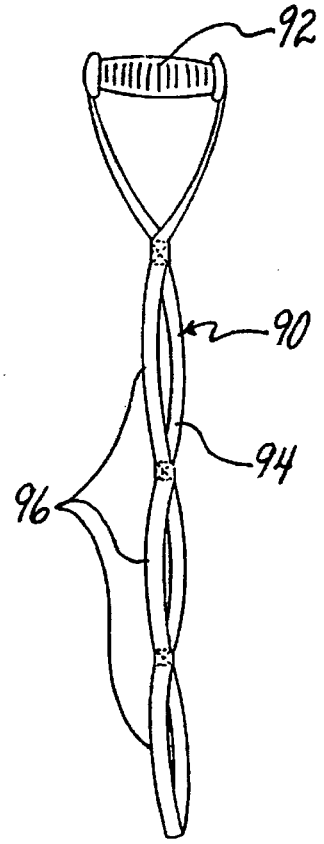
FIG. 3 is a plan view of the cord for assisted movement component included in the kit of the present invention.

Cord 90, shown in detail at FIG. 3, consists of handle 92 which is attached to strap 94 of nylon or other suitable material. Cord 90 has been divided into several loops 96 to provide adjustment to patient's of differing physical sizes. Depending upon the size of the patient, the proper loop 96 is selected and attached around toe end 32 of foot pedal 24 and into toe slots 38 to provide dorsiflexion movement. Cord 90 can also be used independently of base plate 22 and foot pedals 24, by attached loop 96 directly around the toe end of the patient's foot. As the patient pulls handle 92 upward, the toe is passively dorsiflexed. This motion is useful to maintain range of motion and prevent shortening of the Achilles tendon (foot drop). During this movement, muscles in the arm, shoulders and hands are also exercised. This apparatus is designed primarily for paralyzed individuals.

Figure 4:
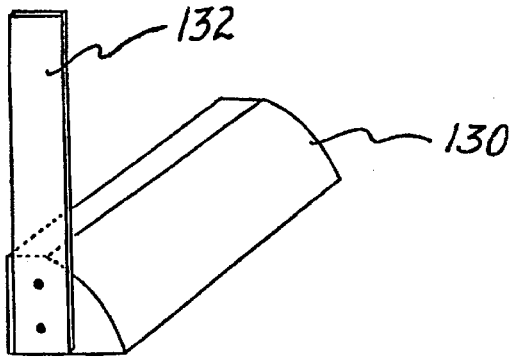
FIG. 4 is a perspective view of the wedge for foot rest included in the kit of the present invention.
Figure 5:
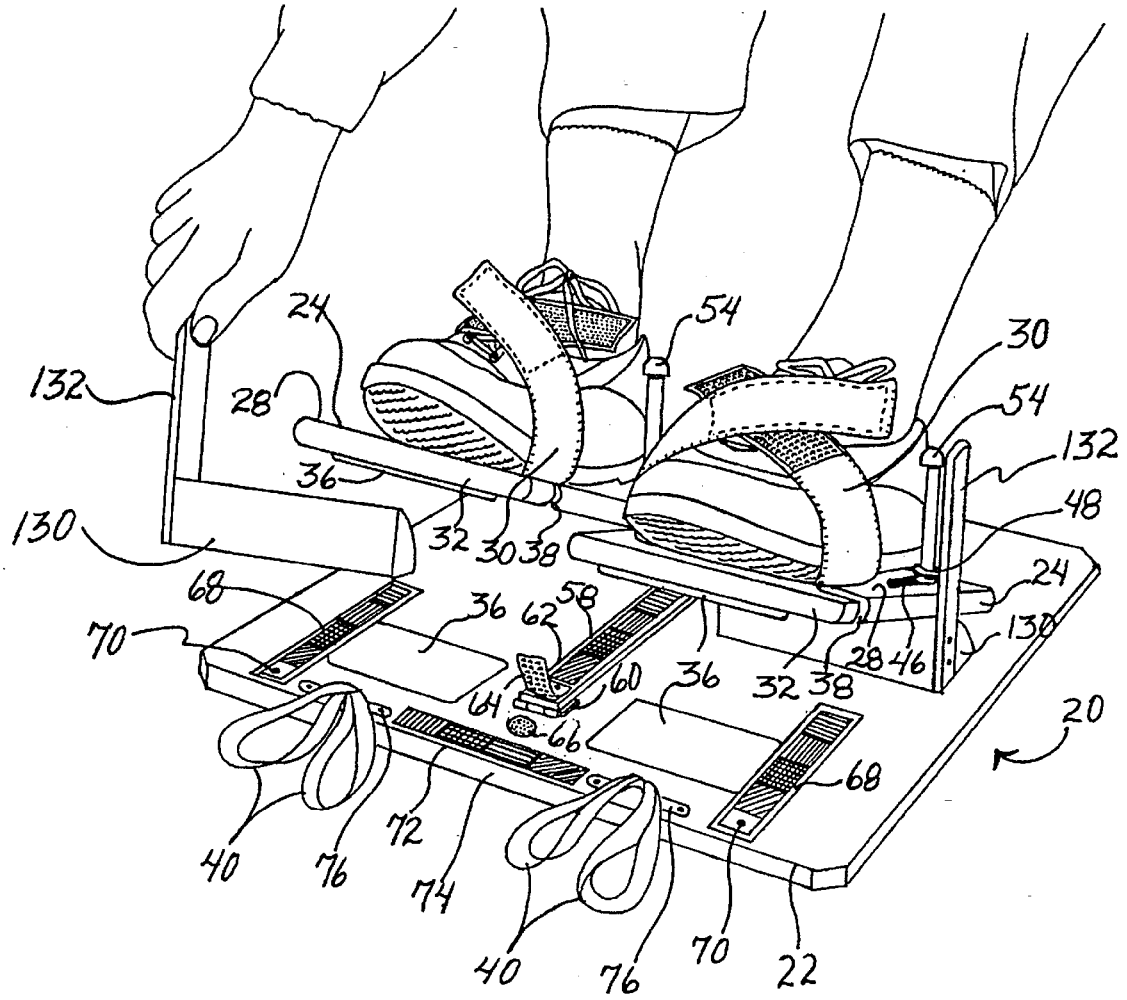
FIG. 5 is a perspective view of an assembly of kit components with the wedge for foot rest in place as used by a patient.

Therapeutic lower extremity exerciser 20 can also function as an adjustable foot rest, as illustrated at FIG. 5. Each foot pedal 24 can be independently adjusted by placing wedge 130, shown in detail at FIG. 4, at a desired position under the patient's foot for use at rest. Handle 132, in actual use conditions of a rigid plastic although other materials such as wood could be used, is fastened to wedge 130, of dense foam, although rubber, wood or other suitable material could be used. Handle 132 is provided for ease-in positioning wedge 130. Wedge 130 is placed between base plate 22 and foot pedal 24 with handle 132 perpendicular to base plate 22 and situated adjacent to the outer edge of foot pedal Forward or backward positioning of wedge 130 regulates the incline or height of foot pedal 24 at rest. Use of wedge 130 passively dorsiflexes the foot, and passively stretches the Achilles tendon and calf muscles. This aids in retarding or preventing the development of the condition known as "foot drop", a common problem for those suffering from multiple sclerosis, myasthenia gravis and stroke among other medical disorders and diseases.

Figure 6:
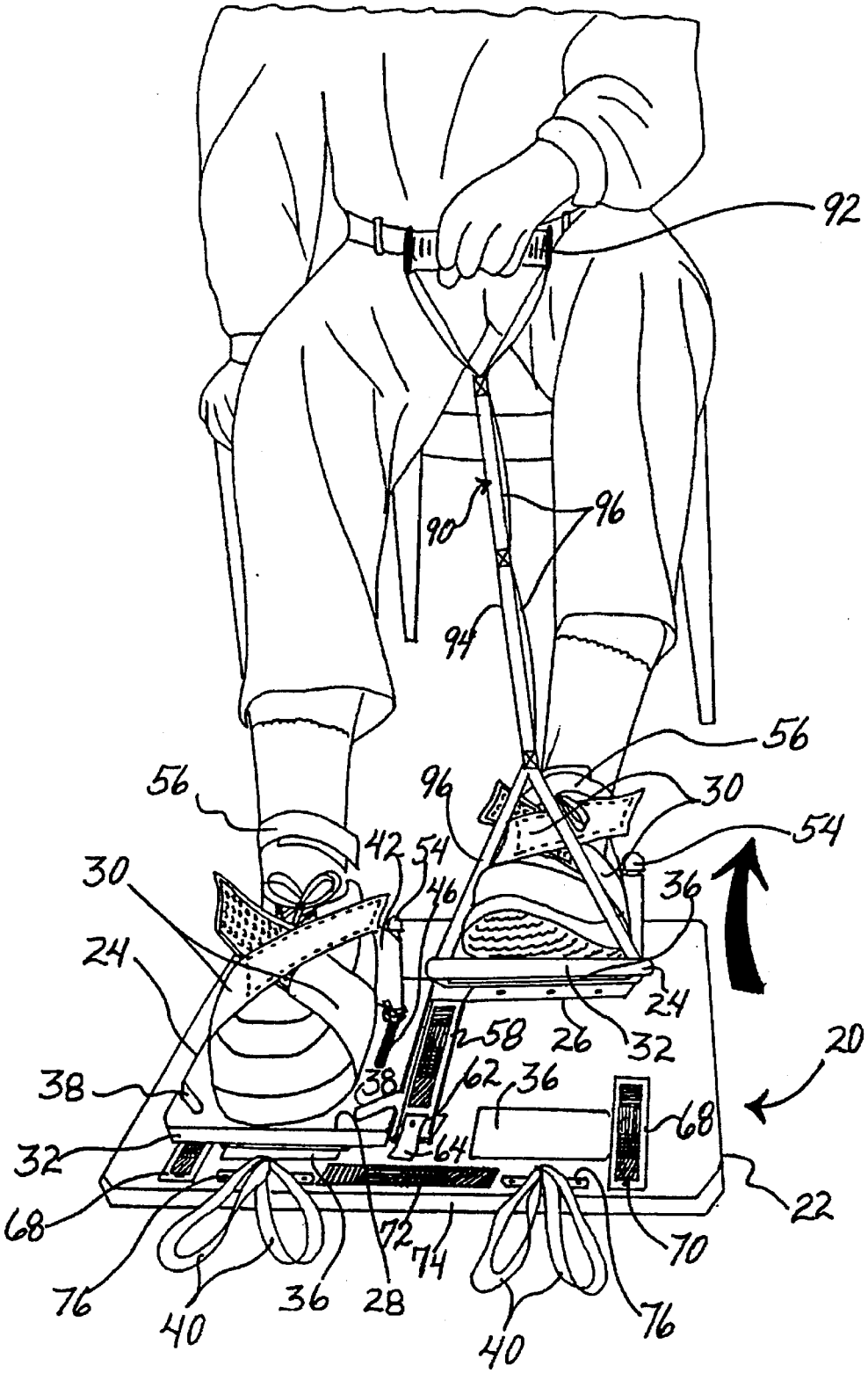
FIG. 6 is a perspective view of an assembly of kit components with the cord for assisted movement in place as used by a patient.

FIG. 6 illustrates cord 90 in its position of use, in conjunction with base plate 22 and pedal 24, providing dorsiflexion motion to assist in the maintenance of mobility rather than muscular strengthening exercise, especially important for patients with mobility problems. Cord 90 provides passive movement by lifting the toe for dorsiflexion of foot in response to pulling on handle 92 of cord 90. This motion stretches the Achilles tendon of the patient, preventing "freezing" of the ankle joint. Additional movement is provided to the knee joint. This range of motions is particularly helpful to stroke victims having loss of control of their legs and to those having accidental injury to the leg, ex. following removal of a cast. Base plate 22 provides control of foot position. Cord 90 could also be used independently, without base plate 22, not shown. Independent use of cord 90 provides assistance to those with paralysed legs in getting in and out of, e.g. wheelchair, car, bed, etc.

Figure 7A:
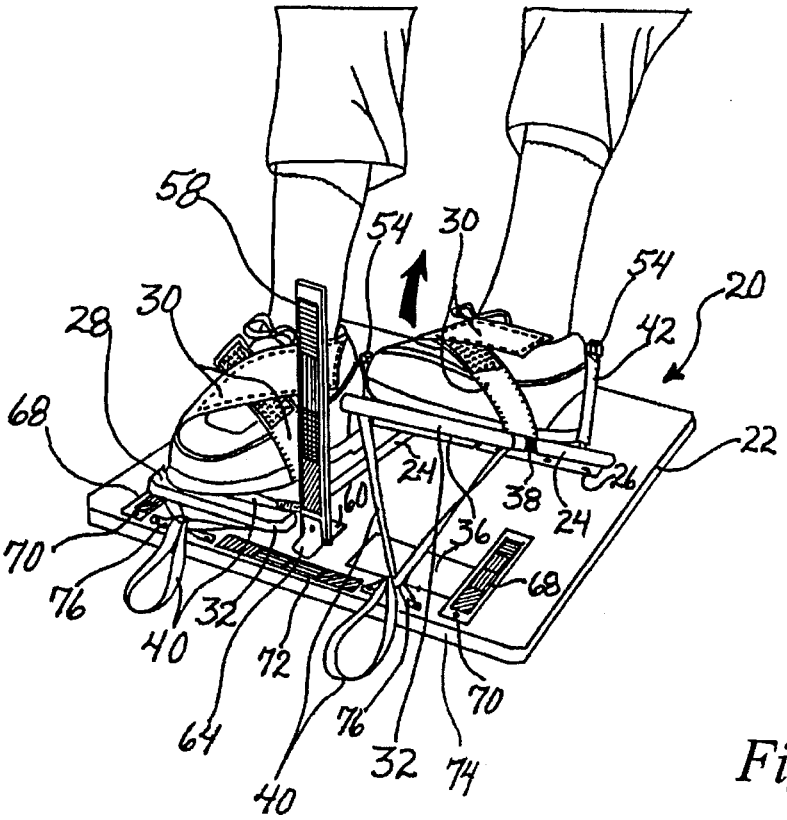
FIG. 7*a* is a perspective view of an assembly of kit components with elastomeric bands in place for lower foot dorsiflexion strengthening exercise as used by a patient.
Figure 7B:
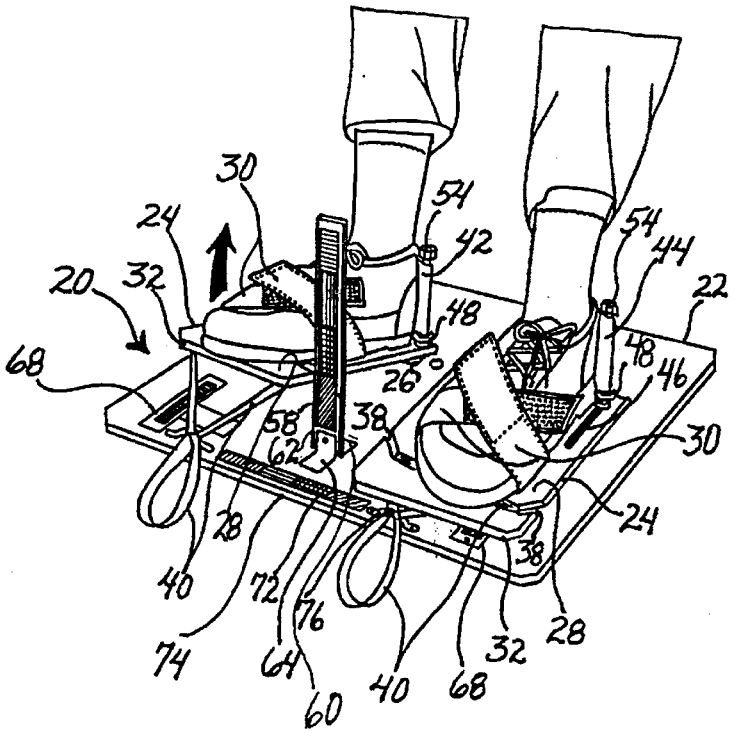
FIG. 7*b* is a perspective view of the assembly of kit components as shown in FIG. 7*a*, reversing the dorsiflexion movement as used by a patient.

FIG. 7*a* and 7*b* illustrate therapeutic lower extremity exerciser 20 in use to provide resistance to dorsiflexion movement to exercise muscles in front of the lower leg. Some knee and thigh movement can also be provided by positioning base plate 22 at a greater distance from the seated patient. If base plate 22 is positioned at an increased distance from the seated patient, even the thigh muscles can be involved in this exercise. FIG. 7*a* and 7*b* also-illustrated the manner in which movement by the patient may be measured by use of guide strip Be held in its position of use by means of hook 64 and loop 66 attachments, shown in detail in FIG. 1. Specifically, in FIG. 7*a*, the left foot of patient is being dorsiflexed by this device, while FIG. 7*b* illustrates the right foot being dorsiflexed. The patient's right and left feet may be exercised in tandem or independently using the device of this invention. In addition to dorsiflexion movement, the back of leg muscles are also stretched using these components.

Figure 8A:
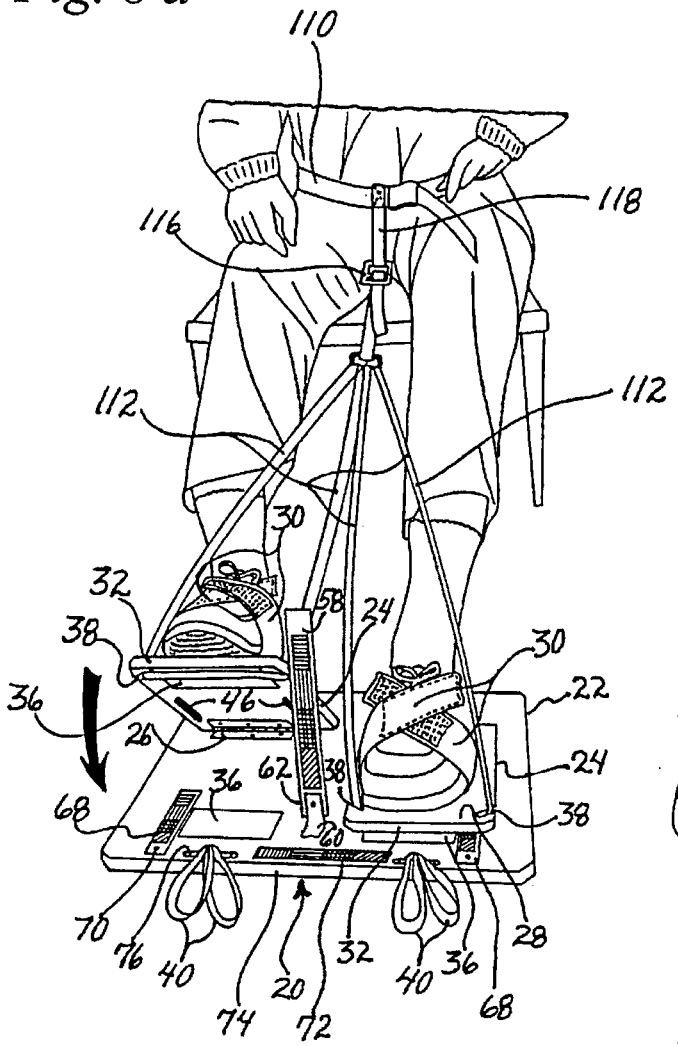
FIG. 8*a* is a perspective view of an assembly of kit components with the belt with elastomeric loops in place for plantar flexion strengthening exercise as used by a patient.
Figure 8B:
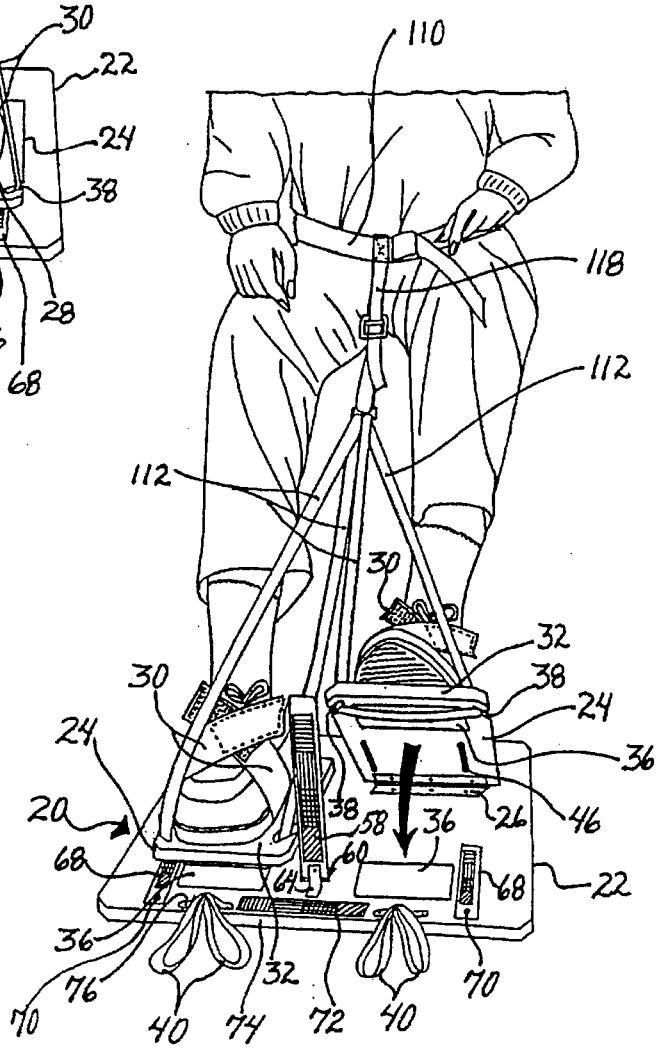
FIG. 8*b* is a perspective view of the assembly of kit components as shown in FIG. 8*a*, in place for plantar flexion movement by the opposite foot as used by a patient.

FIG. 8*a* and 8*b* illustrate therapeutic lower extremity exerciser 20 in a position of use with the patient in a seated position with the addition of components belt 110 and loop 112, illustrated in detail at FIG. 2. Plantar flexion movement, flexing back of leg muscles, stretching the front of leg muscles, is the movement sought. Some knee and thigh involvement can occur, depending on where exerciser 20 is placed relative to patient. Elastomeric loops 112 provide resistance to this movement. Additional loops and stronger loops can be attached in the manner illustrated to increase resistance to this movement. Preferably flat elastomeric loops are used because tubular elastomeric loops tend to slip off the patient's foot readily interrupting the exercise, which is especially important when used independently of base plate 22. Additionally, guide strip 58 is shown in its position of use providing easy means for measuring patient movement. Again, the patient's right and left legs may be used in tandem or independently. Also, the patient can use belt 110 without base plate 22 component increasing the ease of transporting this exercise device, again, flat loops are particularly important when belt 110 is used independently of base plate 22. Belt 110 assembly could be used e.g., in a confined area such as on an airplane. Both methods of using belt 110 frees the patient's hand for other purposes during the exercise movements.

FIG. 9*a* and 9*b* illustrate therapeutic lower extremity exerciser 20 in a position of use with the patient in a seated position with toe straps 30 not in use for providing a pivoting movement of the foot about the ankle, specifically for internal and external rotation of the foot. Ankle straps 56 and heel strap 42 position the patient's foot on the exerciser 20. Elastomeric band 40 provides resistance to the movement, thus exercising the patient's foot muscles. Additional elastomeric bands 40 can be added to increase resistance to movement. Side guide strip 68 are provided to provide easy measurement of the amount of patient's movement. Loosening of ankle straps 56 enable patient to exercise a different set of foot and lower leg muscles by providing for inversion and eversion movement of the feet. All of these ankle and foot exercises help maintain joint mobility and prevent "freezing" of the ankle joint. These exercises can be used to strengthen and condition the muscles for rehabilitation purposes and to maintain joint flexibility in the case of degenerative disease.

Although the present invention has been described on considerable detail with reference to certain preferred versions thereof, other versions are possible. For example a base plate and pedal components could be constructed of wood. Also, tubular elastomeric loops and bands could be used. Therefore, the spirit and scope of the appended claims should not be limited to the description of the preferred versions contained herein.

What is claimed is:

1. A lower extremity exercise kit having a plurality of interactive components, combination of the components in a plurality of configurations to form a plurality of means for strengthening the lower extremity of a patient having limited lower extremity strength and motor ability, the lower extremity exercise kit comprising:

a) a base plate;

b) at least one pedal having a heel end and a toe end having a pair of slots formed along opposite lateral edges of each pedal intermediate the heel end and toe end, said pedal hingedly attached at only the heel end thereof directly to the relatively larger base plate, said pedal adapted and designed for receiving the patient's foot for allowing the patient to perform dorsiflexion and plantar flexion movements;

c) a heel strap, having adjustment means to accommodate a variety of foot sizes, mounted near the heel end of each pedal for positioning the heel of the patient during use;

d) a toe strap, affixed near the toe end of each pedal, with fasteners mounted at ends of each strap, for releasably receiving patient's toes by the pedal;

e) at least one elastomeric band, affixed to an edge of the base plate and centered in front of the toe end of each pedal, said elastomeric band looped around the toe end of each pedal and held in position by said pair of slots formed along opposite lateral edges near the toe end formed within each pedal, for providing resistance against dorsiflexion movements of the patient's foot;

f) a pair of ankle straps attached to said base for maintaining the position of the patient's heel adjacent the pedal during use for internal and external rotation of the foot; and g) the base plate sized to extend completely beyond an exterior perimeter of the pedal.

2. The apparatus of claim 1, further comprising a measurement guide system, having a first measurement guide affixed at an end thereof to the base plate at a position adjacent the toe end of the pedal, for measuring dorsiflexion and plantar flexion range of motion of the patient's foot independently of the other foot.

3. The apparatus of claim 2, wherein the base plate is sized to extend beyond the heel end of the pedals attached thereto, to prevent rocking of the base plate during use.

4. The apparatus of claim 1, wherein the means for adjusting the heel strap further comprise a pair of bolt and nut arrangements, received by a slot formed in the heel end of the pedal, for adjusting the position of the heel strap on the pedal.

5. The apparatus of claim 1, further comprising a wedge positionable on the base plate beneath each pedal and intermediate between the toe and heel ends of each pedal, thereby positioning each pedal and patient's foot thereon in an inclined position relative to the base plate, when each pedal is unrestrained by the elastomeric band, for passively stretching the Achilles tendon of the patient during rest.

6. The apparatus of claim 1, further comprising a cord, having a handle at an end thereof, and a series of loops formed in the cord at spaced locations relative to the handle for receiving the toe end of a pedal at a predetermined distance relative to the handle, such that pulling on the handle of the cord provides passive movement of the patient's foot on the pedal and provides active stretching of the patient's Achilles tendon.

7. The apparatus of claim 6, the pair of ankle straps, further comprising fasteners mounted at ends of the straps for releasable attachment around a patient's ankle, for positioning the patient's heel for internal and external rotation of the foot.

8. A lower extremity exercise kit having a plurality of interactive components, combination of the components in a plurality of configurations to form a plurality of means for strengthening the lower extremity of a patient having limited lower extremity strength and motor ability, the lower extremity exercise kit comprising:

a) a base plate;

b) at least one pedal having a heel end and a toe end and a slot formed intermediate the heel end and toe end, hingedly attached at only the heel end thereof to the relatively larger baseplate, said pedal adapted and designed for receiving the patient's foot;

c) a heel strap mounted near the heel end of each pedal for positioning the heel of the patient during use;

d) an ankle strap, affixed to the base, with fasteners mounted at ends of the straps, for releasably positioning a patient's ankle on each pedal; and e) at least one elastomeric band, affixed to an edge of the base plate near the toe end of each pedal, said elastomeric band receivable by a slot formed within each pedal at a point intermediate between the heel end and the toe end, the band extending beyond the slot to form a loop into which the patient's foot is placed for providing resistance for the ankle of the patient's foot exerting external and internal rotation exercise movement there against.

9. The apparatus of claim 8, further comprising a pair of measurement guides, pivotably affixed to the base plate at a position adjacent the toe end of the pedal, for measuring external and internal rotation exercise range of motion of the patient's foot about the ankle.

10. The apparatus of claim 8, further comprising adjustment means wherein the ankle strap is sufficiently adjustable, by loosening the fasteners mounted at ends of the strap, for releasably positioning a patient's ankle on each pedal, to permit the patient's foot to exert inversion and eversion movement there against.

11. The apparatus of claim 10, wherein the base plate is sized to extend beyond the heel end of the pedals attached thereto, to prevent rocking of the base plate during use.

12. A lower extremity exercise kit having a plurality of interactive components, combination of the components in a plurality of configurations to form a plurality of means for strengthening the lower extremity of a patient having limited lower extremity strength and motor ability, the lower extremity exercise kit comprising:

a) a base plate sized to provide a stationary base on which therapeutic exercises may be performed;

b) at least one pedal having a heel end and a toe end having a pair of slots formed along opposite lateral edges of each pedal intermediate the heel end and toe end, said pedal hingedly attached at only the heel end thereof to the base plate, the back of the base plate extending beyond the point where the pedal is hingedly attached such that pivoting of the pedal about the hinge is accomplished without rocking the base, said pedal adapted and designed for receiving the patient's foot for allowing the patient to perform dorsiflexion and plantar flexion movements;

c) a heel strap, having adjustment means to accommodate a variety of foot sizes, mounted near the heel end of each pedal for positioning the heel of the patient during use;

d) a toe strap, affixed near the toe end of each pedal, with fasteners mounted at ends of each strap, for releasably receiving patient's toes by the pedal; and e) at least one elastomeric band, affixed to an edge of the base plate and centered in front of the toe end of each pedal, said elastomeric band looped around the toe end of each pedal and held in position by said pair of slots formed along opposite lateral edges of each pedal, said elastomeric band for providing resistance against dorsiflexion movements of the patient's foot; and f) a belt having at least one elastomeric loop attached thereto for positioning the loop in the toe slot of the pedal for providing resistance to plantar flexion movement of the patient.

13. The apparatus of claim 12, further including means for providing resistance against inversion and eversion movements of the patient's foot.

14. The apparatus of claim 13, further comprising measurement guides, affixed at an end thereof to the base plate at positions adjacent the toe end of the pedal, for measuring dorsiflexion, plantar flexion, internal and external rotation, inversion and eversion ranges of motion of a patient's foot.

* * * * *